US005938548A

United States Patent [19]

Upshaw

[11] Patent Number: 5,938,548

[45] Date of Patent: Aug. 17, 1999

[54] TRAINING DEVICE FOR IMPROVING BATTING SKILLS

[76] Inventor: Willie Upshaw, 776 Hill Farm Rd., Fairfield, Conn. 06430

[21] Appl. No.: 09/046,141

[22] Filed: Mar. 23, 1998

[51] Int. Cl.[6] ..... A63B 69/00; A63B 71/02

[52] U.S. Cl. ..... 473/453; 473/458

[58] Field of Search ..... 473/451, 453, 473/458, FOR 102, FOR 103, FOR 106; 434/247

[56] References Cited

U.S. PATENT DOCUMENTS

| | | | |
|---|---|---|---|
| 1,655,092 | 1/1928 | Davis . | |
| 1,699,219 | 1/1929 | Bemish et al. . | |
| 2,450,162 | 9/1948 | Promen . | |
| 4,239,228 | 12/1980 | Norman et al. . | |
| 4,377,284 | 3/1983 | Okerlin . | |
| 4,890,841 | 1/1990 | Brooks . | |
| 4,960,280 | 10/1990 | Corder . | |
| 5,154,416 | 10/1992 | Smull et al. | 473/458 |
| 5,295,690 | 3/1994 | Johnson . | |
| 5,601,285 | 2/1997 | Baxter | 473/458 |

*Primary Examiner*—John A. Ricci

*Attorney, Agent, or Firm*—H. Gibner Lehmann; K. Gibner Lehmann

[57] ABSTRACT

A simplified training device for improving the batting skill of a batter in baseball, has a pair of arm cuffs adapted to encircle the arms of the batter at a location above the elbows thereof, and a pair of elongate flexible tie straps which are coextensive with each other and which extend between and are connected to the arm cuffs. The device is so constituted that the tie straps can be easily adjusted as to their effective lengths. When the tie straps are taut, they positively limit the maximum space between the arm cuffs at the time that the batter's arms are in a raised, retracted position. The straps are flexible and capable of collapsing movement to enable the arm cuffs to approach each other as the batter's arms are swung from the raised, retracted position toward the extended, ball-striking position.

13 Claims, 2 Drawing Sheets

TRAINING DEVICE FOR IMPROVING BATTING SKILLS

NO CROSS REFERENCES TO RELATED APPLICATIONS

STATEMENT AS TO RIGHTS TO INVENTIONS MADE UNDER FEDERALLY-SPONSORED RESEARCHED AND DEVELOPMENT

Research and development of the present invention and application have not been Federally-sponsored, and no rights are given under any Federal program.

BACKGROUND OF THE INVENTION

1. Field of the Invention

This invention relates generally to the game of baseball, and more particularly to training devices for improving the skills of baseball batters.

2. Description of the Related Art Including Information Disclosed Under 37 CFR §§1.97–1.99

In the past many devices have been proposed and produced to improve the skills of athletes. In U.S. Pat. No. 1,655,092 there was disclosed a golf swing connector in the form of two arm bands that were connected together either by separable elastic webbing strips or else by a rigid bar means which controlled their spacing. The bar means involved a number of components, and was heavy and not comfortable to use. Moreover, the elastic webbing connector was difficult to adjust and could not provide a positive separation of the arm bands, as was later found to be important.

In U.S. Pat. No. 1,699,219 a golf harness was disclosed. This device embraced a belt having a buckle, the belt being intended to encircle the user's body. Attached to the belt were arm cuffs which were not controlled as to their spacing, to limit the maximum allowable distancing thereof in a positive manner, nor permit necessary closer spacing to maximize the benefits that were sought. The body-encircling belt was also unduly restrictive, interfering with the stroke of the arms.

In U.S. Pat. No. 2,450,162 a golf practice device was disclosed, comprising two arm bands with buckles for adjustment, and an articulated linkage comprising a metal clasp and hook member. The metal linkage was awkward and not capable of adjustment as to its length, to properly control the spacing of the user's arms. The buckles did not permit the proper positioning of the arm cuffs, nor fitting of the same to accommodate different physiques without interfering with the arm movements.

In U.S. Pat. No. 4,239,228 a golf swing training device is revealed, comprising arm restrainers which utilize Velcro interacting strips. However, the configurations shown, and their cooperative relationships are such that they fail in their functions when heavy forces are involved, such as with athletes having strong physiques.

U.S. Pat. No. 4,377,284 reveals a basketball training device involving strip material all of which is flexible and stretchable. This device is incapable of providing a positive, nonyielding restraint upon the users arms for certain maneuvers, and is therefore of questionable use in circumstances where the training requires such restraint.

U.S. Pat. No. 4,890,841 describes a golf swing aid which includes a body-encircling belt that fits around the shoulders of the golfer. This arrangement is of no use in the training and positioning of the user's elbows and lower arms.

In U.S. Pat. No. 4,960,280 there is described a training device for golfers, which utilizes a belt that encircles the user's body. This places an undue restriction on certain movements required of the back and arm muscles, in developing the necessary skills required in the game of baseball.

U.S. Pat. No. 5,295,690 shows a device for improving a golf swing, in the form of arm cuffs which are interconnected by an elastic band or strip. Such band or strip does not impose any positive restraint on the user's arms during the raising of the latter in preparation for the swing, and is deficient in this respect in accomplishing the intended purpose.

SUMMARY

The above drawbacks and disadvantages of prior athletic training devices are obviated by the present invention, and one object of the invention is to provide an improved training device for improving the batting skills of a baseball player, which device is at one and the same time especially simple while still providing for convenient precise adjustments enabling it to be readily accommodated to the physique of the user and to obtain a maximum degree of effectiveness in controlling important arm positioning.

Another object of the invention is to provide an improved training device for baseball batters as above set forth, which is small, compact and light in weight whereby it can be easily folded into little space and stored or else carried, as desired.

A further object of the invention is to provide an improved training device for batters in accordance with the foregoing, which is strong and durable, being especially unlikely to malfunction when in use.

A feature of the invention is the provision of an improved training device as described above, which is safe in use and presents no hazard to the user at any time.

Another feature of the invention is the provision of unique means for adjustment of the various components in a training device of the kind described, all adjustments being possible with a minimum of inconvenience and time being required.

A further object of the invention is to provide an improved training device as characterized above, which is especially comfortable to wear and to use.

Yet another object of the invention is to provide an improved training device as above set forth, which can be easily fabricated from materials that are currently available in the market place, all without the requiring of special tooling or equipment.

A still further object of the invention is to provide an improved training device as above described, which can be readily immediately put into use without first requiring any set-up or assembly operations.

Other features and advantages will hereinafter appear, including ready adaptability to various and different requirements of use, involving not only sizes but also differences of sex and age.

In accomplishing the above objects the invention provides a unique training device for improving batting skills comprising basically a pair of arm cuffs adapted to encircle the arms of the batter at a location above the elbows thereof, a pair of elongate flexible tie strap connector means which are coextensive with each other and which extend between and are connected to said arm cuffs, and finally simplified and positive means for adjusting the effective lengths of the said tie strap means, thereby to regulate the distance between the arm cuffs. The tie strap means when adjusted to be taut are capable of positively limiting the maximum space between the arm cuffs at the time that the batter's arms are in a raised, retracted position, and are capable of a collapsing movement to enable the arm cuffs to come closer to each other as the batter's arms are swung from the said raised retracted position to an extended, ball-striking position.

BRIEF DESCRIPTION OF THE DRAWINGS

In the accompanying drawings, illustrating an embodiment of the invention.

DESCRIPTION OF A PREFERRED EMBODIMENT

Figure 3:
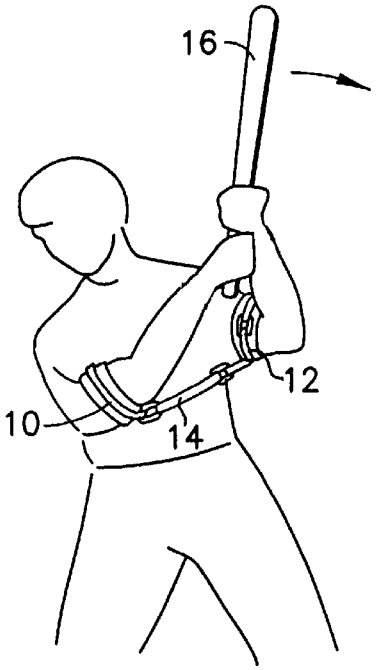
FIG. 3 is a diagrammatic representation of a baseball batter having the present improved device installed on his arms and showing the various positions of his body at the beginning of a swing.
Figure 4:
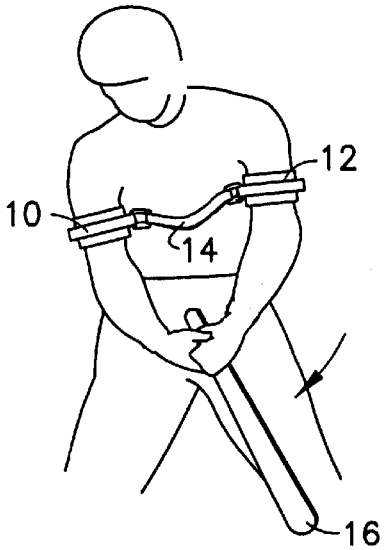
FIG. 4 is a view like that of FIG. 3 but showing the arm and body positions of the batter at or just prior to the impact positions being attained.

Referring first to FIGS. 3 and 4, the present improved batting training device of the invention comprises generally in its important component parts, a pair of arm cuffs 10 and 12 adapted to be worn just above the elbows of the batter, and a connector means 14 which joins the arm cuffs 10 and 12 to each other. Basically the action of the arm cuffs 10, 12 and the connector means 14 is to restrain separating movement of the batter's arms during the initial or preparatory portion of the swing while not interfering with free movement of the arms when the full swing is being carried out past the point of impact of the bat 16 with a thrown ball.

I have discovered that such control and restraint is useful in conjunction with proper adjustment of the connector means for the arm cuffs, thereby to develop the necessary swing and coordinating movements of the batter's arms so as to enable him or her to cope with the high velocities developed by today's pitchers in the modern game of baseball as it is currently being played. The connector means 14 as provided herein is unique, and in combination with the arm cuffs 10 and 12, gives an important and significant control of the cuff and arm movements of the batter to obtain the desired improvement in the batter's performance.

Figure 1:
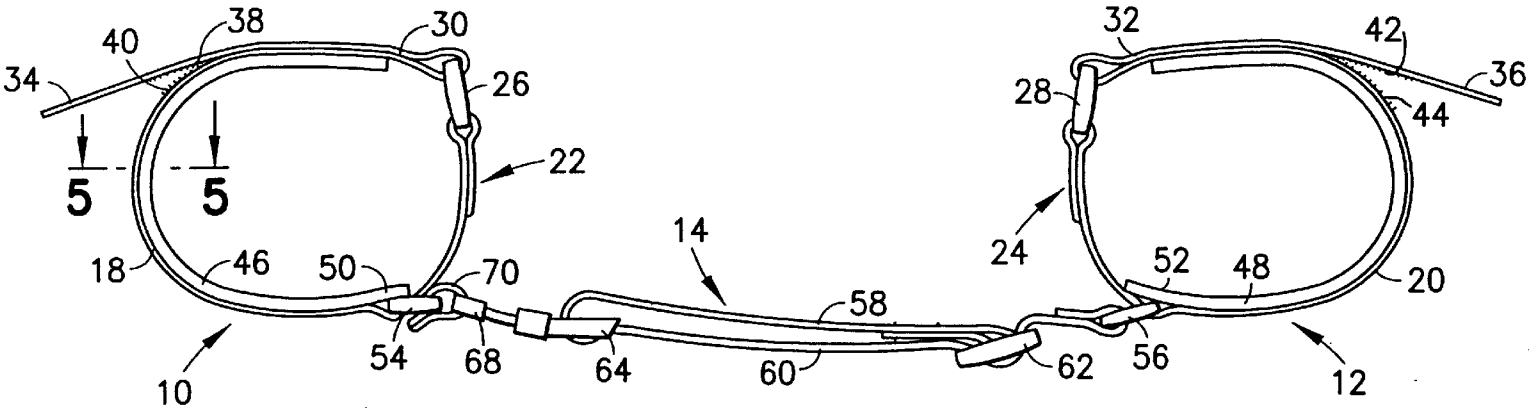
FIG. 1 is a side elevational view of a training device for improving the skills of a baseball batter as provided by the present invention, shown in a position which it occupies when being worn by a batter whose arms are upwardly fully retracted in readiness for executing a swing at a ball which has been thrown to him or her.
Figure 2:
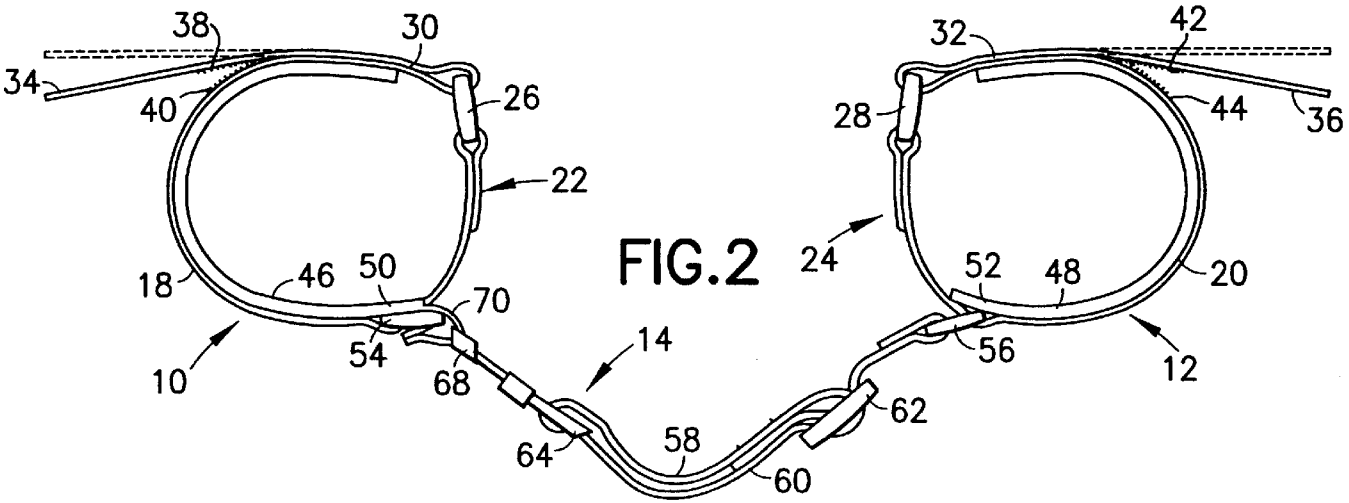
FIG. 2 is a side elevational view like that of FIG. 1 but showing the position of the training device during the execution of a swing at the ball.

Referring now to FIGS. 1 and 2, the arm cuffs 10 and 12 are constituted of elongate strips of strong webbing 18 and 20 respectively, each strip being formed into a loop that is large enough to be slipped over the arms of a batter to a point just beyond the elbows thereof. Corresponding end portions 22 and 24 of the webbing strips 18 and 20 pass through coupling rings 26 and 28 respectively, with the terminals or ends of the strips being folded over and stitched to secure the ends to the rings. Intermediate portions 30 and 32 of the webbing strips also pass through the coupling rings 26 and 28 and extend back over upper portions of the webbing, terminating in finger-engageable pull terminals 34 and 36.

The overlapping portions of the webbing strips 18 and 20 are provided with hook and loop configurations 38, 40 and 42, 44 such as those sold under the VELCRO® brand, whereby the webbing strips can be tightened around the batter's arms and secured in place as shown.

Figure 5:
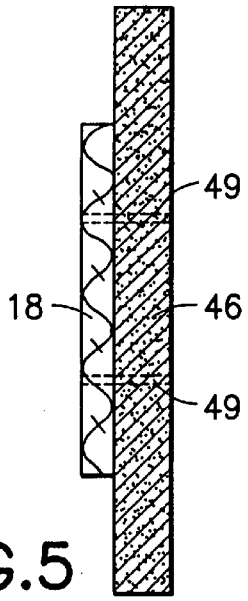
FIG. 5 is a fragmentary sectional view through one of the arm cuffs of the device, taken on the line 5—5 of FIG. 1.

The arm cuffs 10 and 12 are lined with semi-circular cushion pads 46 and 48, secured as by stitching 49, see FIG. 5.

At the lower inner ends 50 and 52 of the cushion pads 46 and 48, they are stitched to coupling rings 54 and 56 which are interposed between such ends and the webbing strips 18 and 20. The construction as thus far explained describes the arm cuffs 10 and 12, which are now joined to each other by a unique and novel connector means comprising a pair of flexible tie strap sections 58 and 60 constituted of a single piece of woven webbing. The single piece of webbing 58, 60 passes through a slider or traveller ring 62 of the type having a center bar, as in FIG. 6.

Figure 6:
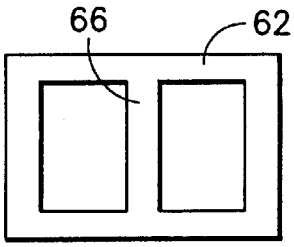
FIG. 6 is a plan view of a single cross bar slider or traveller ring as used in the device of FIGS. 1 and 2.
Figure 7:
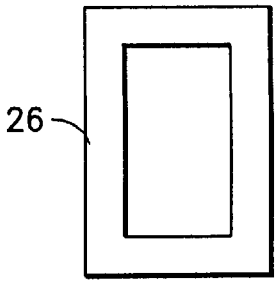
FIG. 7 is a plan view of a coupling ring as used in the device of FIGS. 1 and 2.

A coupling ring such as the ring 26 is shown in FIG. 7, and the slider or traveller ring 62 is shown in FIG. 6. As illustrated, one section of the connector strap means 58, 60 passes through the coupling ring 56 and is sewed back on itself to permanently secure it to the coupling ring. The webbing strip section 60 has been passed into and then out of the traveller ring 62 as shown, then through a clasp part 64, now becoming the strap section 58 which overlies the strap section 60, being integrally connected and coextensive therewith, and then around the cross bar 66 of the traveller ring 62 to be anchored thereto.

The clasp part 64 is separably attached to a companion clasp part 68 which is permanently joined by a webbing loop 70 to the coupling ring 54.

With the above construction, the flexible tie strap connector means 14 is now adjustable as to its length, by shifting the traveller ring 62 to different positions on the tie strap section 60 and taking up slack by shifting the sections 58, 60 through the clasp part 64; such adjustment is thus effected without involving any loose ends, tightening devices or pierced portions of the webbing or the like.

With the present improved arm restraint device in place, the connector means 14 can be very precisely adjusted as to its length by sliding the traveller ring 62 to different places on the strap section 60 so that it is tight for the batter's position shown in FIGS. 1 and 3, and is loose as in FIGS. 2 and 4 showing the batter's position wherein the bat 16 is in the striking zone. This enables the training device to be quickly and easily fitted and adapted to the various physiques of different players, from small to large, so as to give it the maximum effectiveness in the training procedures.

Each and every one of the appended claims defines an aspect of the invention which is complete in and of itself, separate and distinct from all the others, and accordingly it is intended that each claim be treated in this manner when examined in the light of the prior art devices in any determination of novelty or validity.

Variations and modifications are possible without departing from the spirit of the invention, and portions of the improvement can be used without others.

LISTING OF REFERENCE NUMERALS

10. arm cuff
12. arm cuff

14. tie strap connector means
16. bat
18. strip of webbing
20. strip of webbing
22. end portion of webbing
24. end portion of webbing
26. coupling ring
28. coupling ring
30. intermediate webbing portion
32. intermediate webbing portion
34. pull terminal
36. pull terminal
38. Velcro® configuration
40. Velcro® configuration
42. Velcro® configuration
44. Velcro® configuration
46. cushion pad
48. cushion pad
50. inner end of cushion pad
52. inner end of cushion pad
54. coupling ring
56. coupling ring
58. flexible tie strap section
60. flexible tie strap section
62. traveller ring
64. clasp part
66. cross bar of traveller ring
68. companion clasp part
70. webbing loop

What is claimed is:

1. A training device for improving the batting skill of a batter in baseball, comprising in combination:

a) a pair of arm cuffs adapted to encircle the arms of the batter at a location above the elbows thereof, b) a pair of elongate flexible tie strap connector means which are coextensive with each other and which extend between and are connected to said arm cuffs, and c) means for adjusting the effective lengths of the said tie strap means, thereby to regulate the distance between the arm cuffs, d) said tie strap connector means when taut being capable of positively limiting the maximum space between the arm cuffs at the time that the batter's arms are in a raised, retracted position, and being capable of collapsing movement to enable the arm cuffs to come closer to each other as the batter's arms are swung from said raised retracted position to an extended, ball-striking position.

2. A training device as set forth in claim 1, wherein the tie strap connector means are integrally connected to each other at one pair of adjoining ends.

3. A training device as set forth in claim 2, and further including:

a) a clasp, b) said clasp being connected to the said pair of adjoining ends of the tie strap connector means and to one of said cuffs.

4. A training device as set forth in claim 3, wherein:

a) said clasp is permanently connected to the said one cuff.

5. A training device as set forth in claim 4, wherein:

a) the said permanent connection of the clasp to the said one cuff comprises a coupling ring which is stitched to the cuff and a length of webbing which is stitched in the form of a loop and which is looped to the coupling ring and to the clasp.

6. A training device as set forth in claim 1, and further including:

a) a traveller ring, one of said strap means being anchored to said ring and the other strap means passing through and frictionally engaging said ring.

7. A training device as set forth in claim 6, and further including:

a) a coupling ring, b) the other of said strap means being permanently connected to one of said cuffs by said coupling ring.

8. A training device as set forth in claim 6, wherein:

a) said cuffs comprise elongate strips of webbing and coupling rings, b) one end portion of each of said strips of webbing being permanently attached to a separate coupling ring, c) the other end portions of the strips of webbing having cooperable male and female surfaces of a hook-and-loop fastener and passing through the respective coupling rings to enable adjustment of the sizes of the cuffs.

9. A training device as set forth in claim 8, wherein:

a) the other end portions of the strips of webbing having terminal areas which are free of any hook-and-loop fastener to provide hand grips.

10. A training device as set forth in claim 1, wherein:

a) the arm cuffs are constituted of strips of woven webbing and pads of cushioning material disposed inside of and attached to said strips of webbing.

11. A training device as set forth in claim 1, wherein:

a) said means for adjusting the effective lengths of the tie strap means includes a ring structure which provides for a stepless and precise adjustment.

12. The method of training a baseball player to improve his batting skills, which includes the steps of applying a pair of arm cuffs respectively and attached tether line to his forearms above the elbows thereof, grasping a baseball bat with his hands, withdrawing his arms to the at-ready position so as to tighten the tether line to a taut condition such that it positively limits the distance between his elbows and holds his arms close to the sides of his body, and swinging his arms through the ball-impact zone at the front of his body and thereby loosen the tether line as the bat strikes the ball.

13. The method of claim 12, and further including the step of adjusting the length of the tether line so as to obtain said taut condition when the batter's arms are in the at-ready position.

* * * * *